United States Patent [19]

Bagley

[11] 4,327,917

[45] May 4, 1982

[54] GOLF PUTTING GAME

[76] Inventor: William L. Bagley, 8250 Lankershim Blvd., No. 3 Ivy, North Hollywood, Calif. 91605

[21] Appl. No.: 82,288

[22] Filed: Oct. 5, 1979

[51] Int. Cl.[3] ..... A63B 67/02

[52] U.S. Cl. ..... 273/176 FA; 273/87 R; 273/127 D; 273/179 A

[58] Field of Search ..... 273/85 G, 87 R, 87 C, 273/127 R, 127 C, 127 D, 176 E, 176 F, 176 FA, 176 FC, 176 R, 177 A, 177 R, 179 R, 179 A, 180, 237, 181 R, 181 A, 181 J, DIG. 28, 121 A, 119 A, 183 R, 184 R, 184 A; 364/410; 340/323 R

[56] References Cited

U.S. PATENT DOCUMENTS

| | | | |
|---|---|---|---|
| 1,799,623 | 4/1931 | Swain et al. | 273/176 FA |
| 2,601,552 | 6/1952 | Niewinski | 273/127 R |
| 3,011,791 | 12/1961 | Page | 273/176 FA |
| 3,114,554 | 12/1963 | Hurley | 273/176 FA |
| 3,366,387 | 1/1968 | Koener | 273/176 FA |
| 3,430,959 | 3/1969 | Ross et al. | 273/127 D |
| 3,588,117 | 6/1971 | Hertenstein | 273/176 FA |
| 3,627,318 | 12/1971 | Garbary et al. | 273/127 D |
| 3,979,118 | 9/1976 | Saunders et al. | 273/127 R |
| 3,986,718 | 10/1976 | Long et al. | 273/176 FA |
| 4,093,232 | 6/1978 | Nutting et al. | 273/121 A |
| 4,198,051 | 4/1980 | Bracha et al. | 273/121 A |
| 4,221,384 | 9/1980 | Krynski | 273/127 R |
| 4,235,438 | 11/1980 | Hally | 273/121 A |

FOREIGN PATENT DOCUMENTS

| | | | |
|---|---|---|---|
| 1061263 | 3/1967 | United Kingdom | 273/176 FA |

*Primary Examiner*—Vance Y. Hum

*Attorney, Agent, or Firm*—Christie, Parker & Hale

[57] ABSTRACT

A golf putting game which includes a housing having a horizontally elongated opening into which a standard golf ball can be putted. Horizontally spaced sensors positioned lengthwise of the opening within the housing sense the lateral position of a ball entering the opening. The sensors controlling a numerical display indicate a score based on the position of the ball laterally of the opening. A back plate stops the ball within the housing, and a sensor determines the force with which the ball strikes the back plate. The indicated score is modified if the force on the back plate exceeds an acceptable level. Successive groups of balls can be putted into the opening and the score for each ball within the corresponding ball in the successive groups can be accumulated and individually displayed to permit a number of players to play the game at the same time.

10 Claims, 7 Drawing Figures

P2
INPUT AND DE-BOUNCE ALL SENSORS AND BUTTONS
3-POINT BUTTON PENALTY SENSOR POINT SENSORS 1,2,3 & 4
RESET ?
YES
S
NO
DELAY FOR FOR .02 SECONDS
3 POINT BTN ?
ADD 3 TO CURRENT PLAYERS SCORE
LEAVE PLAYER LIT FOR 6 SECONDS
P3 B
POINT SENSOR ?
1,2,3, OR 4 POINT SENSORS
YES
ADD 1,2,3 OR 4 POINTS TO PLAYERS SCORE
DELAY FOR 2 SECONDS
PENALTY ?
NO
DELAY FOR 2 SECONDS
P3 B
YES
P3 A

GOLF PUTTING GAME

FIELD OF THE INVENTION

This invention relates to a golf putting type game, and more particularly, relates to a putting game with automatic scoring.

BACKGROUND OF THE INVENTION

Game devices have heretofore been proposed which receive a ball that is putted or otherwise rolled toward a target, with some type of scoring arrangement based on the amount of lateral deviation of the ball from a target. However, such known games have not been particularly suited to providing a competitive golf game which is based on the normal golf putting skill of the participants. Furthermore, such known games did not provide scoring which was dependent both on the accuracy with which a ball is putted toward a target, but also the speed with which the ball is putted. Both of these factors of course are necessary to perfecting the putting skill of a golfer.

SUMMARY OF THE INVENTION

The present invention is directed to a self-contained putting game which can be used both as a training device for improving the putting skill of the participant, or as a competitive game for scoring the relative putting skills of several participants. Automatic scoring for one to four players playing a simulated nine holes is provided with a score of each player being accumulated and displayed individually. Scoring is automatically weighted in response to the accuracy and speed with which a ball is putted into an elongated opening in the housing of the game device. Automatic scoring is provided by a group of position sensors which respond to the lateral position of the ball. A particular value is assigned to each position, and this value is displayed numerically in response to the ball tripping a particular one of the sensors. This value is then modified by a velocity sensor, the score being modified to reflect a penalty for putting the ball too hard.

BRIEF DESCRIPTION OF THE DRAWINGS

For a more complete understanding of the invention reference should be made to the accompanying drawings, wherein.

DETAILED DESCRIPTION

Figure 1:
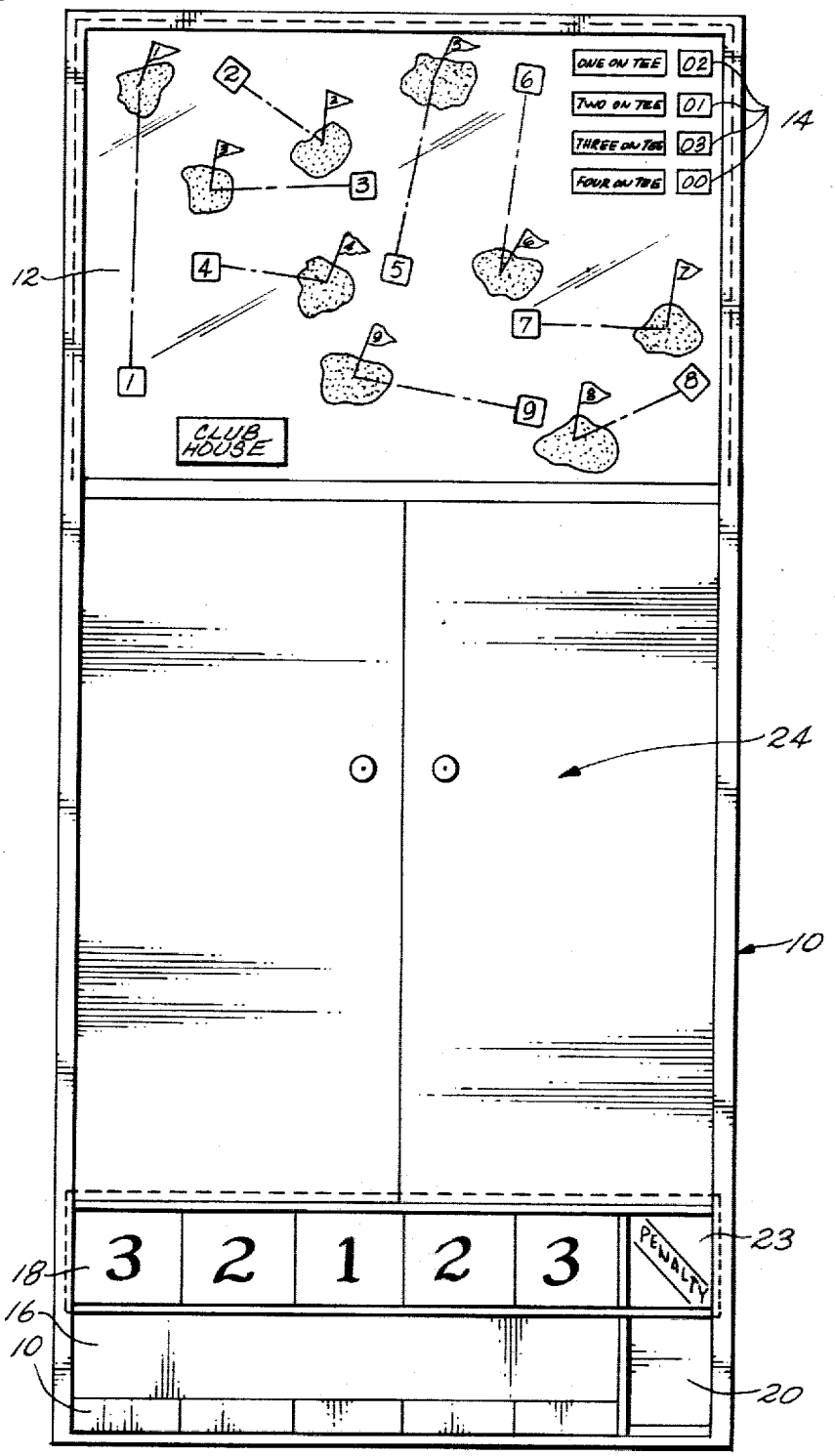
FIG. 1 is a front elevational view of the game apparatus.

Referring to FIG. 1, the numeral 10 indicates generally the housing for the game. The front of the housing includes a display panel 12 which is preferably designed to illustrate a nine-hole golf course layout, including numbered tees and greens. In addition, the display panel includes four numerical readout displays 14 with a display adjacent each readout indicating which one of up to four players is "on the tee".

At the bottom of the front panel of the housing 10 is a horizontal elongated opening 16. The bottom of the opening 16 has a ramp 17 which at its lower edge is in contact with the surface on which the housing is supported. The ramp 17 is preferably divided into five delineated sections. Positioned immediately above the opening 16 is a segmental number display panel 18 having five sections, each of which displays a number. These numbers can be selectively illuminated from the rear to individually illuminate any one of the five displayed numbers.

At the right end of the elongated opening 16 is a ball return chute 20. Immediately above the ball return chute is an illuminated display segment 22 for indicating a penalty condition. A storage cabinet may be provided between the display panel 12 and the numerical display panel 18, as indicated at 24. The cabinet can be used for storing golf balls and a putting mat, for example, for use with the putting game.

Figure 2:
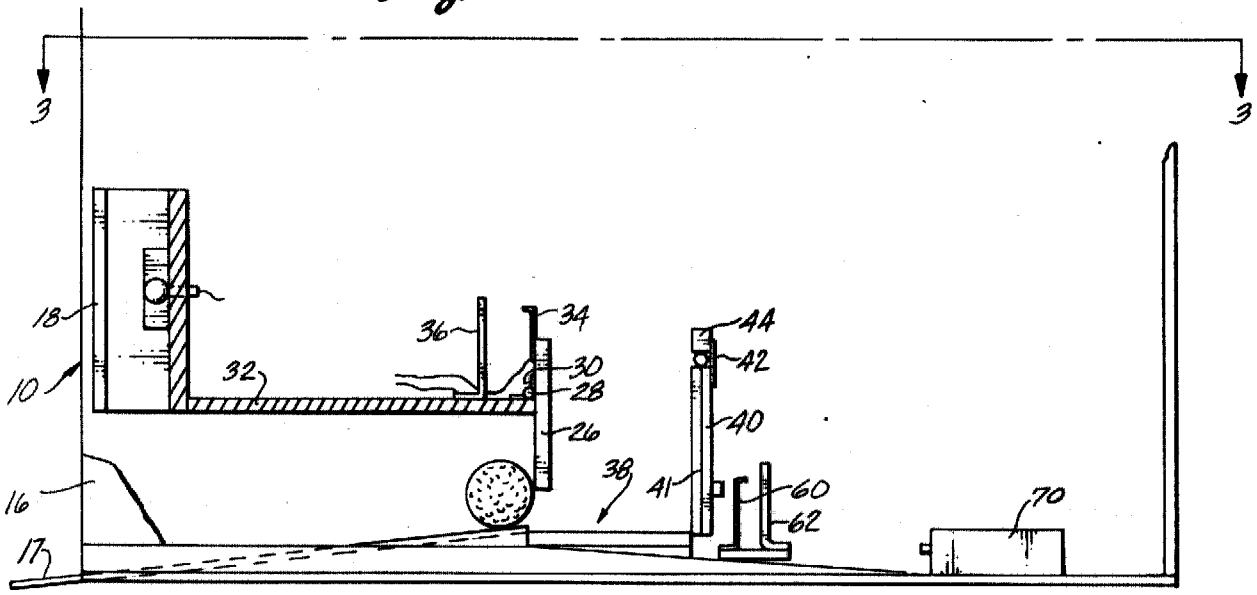
FIG. 2 is a sectional view taken substantially on the line 2—2 of FIG. 1.
Figure 3:
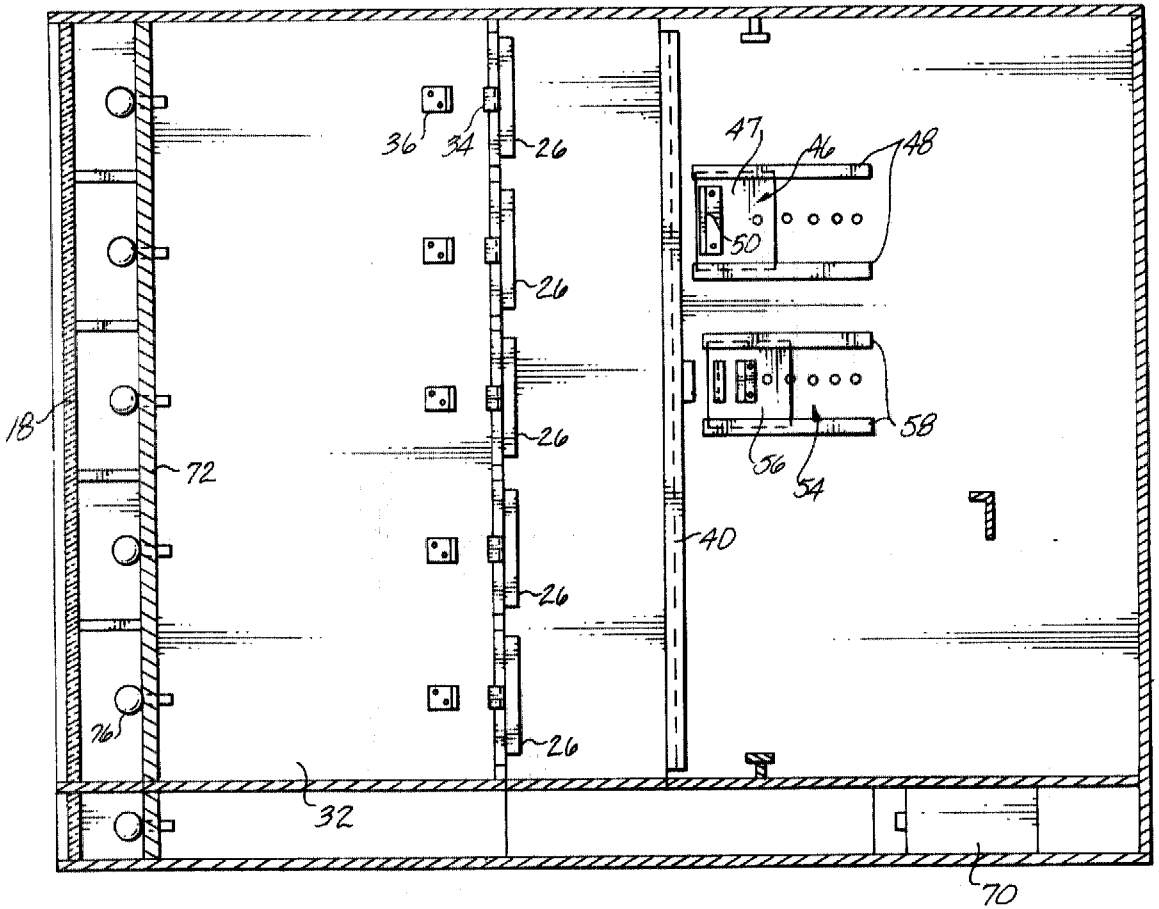
FIG. 3 is a sectional view taken substantially on the line 3—3 of FIG. 2.

The interior construction of the housing is shown in the sectional views of FIG. 2 and FIG. 3. The putted golf ball enters the housing 10 by rolling up the ramp 17 into the elongated opening 16. At the upper end of the ramp 17 the ball contacts one or two of five flipper plates 26 projecting down into the opening 16. The flipper plates 26 are hinged for rotation about a common horizontal transverse axis 28 by individual hinges 30 supported on the back edge of a frame member 32 spanning the interior of the housing and forming the top of the opening 16. The flippers are hinged above their center of gravities so that they tend to move to a vertical position. Supported on the upper end of each flipper 26 is a movable metal switch contact 34 which is rotated by the associated flipper 26 into contact with a fixed switch contact 36 projecting from and supported by the frame member 32. Thus when a golf ball rolls the ramp 17 and engages a flipper 26, the contacts 34 and 36 are brought together to complete an electrical circuit. Thus the switch contacts in combination with the hinged flippers form for sensing the lateral position of the golf ball as it moves up the ramp 17.

The forward momentum of the golf ball causes it to pass under one of the hinged flippers 26, across the width of a trough 38 into engagement with a back stop comprising a board 40 hingedly supported along its top edge by a hinge 42 to a fixed horizontal support member 44 extending parallel to the front of the housing 10. The front surface of the board 40 is preferably covered with a layer of plastic foam material 41 to cushion the impact of the golf ball against the hinged board 40.

Swinging movement of the board 40 rearwardly under impact of the golf ball is resisted by an adjustable spring assembly 46. The spring assembly includes a base panel 47 slidably supported for horizontal movement in a fore and aft direction by a pair of spaced guide tracks 48 mounted on the bottom of the housing 10. A flat cantilever spring 50 projects upwardly from the adjustable base of the spring assembly behind the board 40, thus forming a yieldable stop against which the board 40 impinges when struck by a moving golf ball entering the opening 16.

Mounted adjacent the spring stop assembly 46 is a switch assembly 54 which includes an adjustable base member 56 slidable along a pair of tracks 58 and on which are mounted a pair of metal contacts 60 and 62. Deflection of the board 40 by the golf ball causes the board to push the contacts 60 into engagement with the contact 62 only if the impact of the ball is sufficient to overcome the resistance of the spring 50 and spring contact 62. By adjusting the position of the spring assembly 46 and the switch assembly 54 relative to the board 40, the speed of the golf ball required to close the contacts 60 and 62 can be adjusted.

The bottom of the trough 38 is inclined laterally so as to cause the ball to roll to one side of the housing after it has made impact with the board 40. This brings the ball into contact with a ball return solenoid which propels the ball out of the housing through the ball return chute 20, returning the ball to the player.

A light mounting bracket 72 is for mounting six light bulbs 76 connected respectively to the five contacts 36 of the position sensors and the contact 62 of the velocity sensor formed by the board 40. When one of the flipper control switches is momentarily actuated, the associated light 76 is turned on for two seconds, illuminating the number associated with that lateral position above the opening 16.

Figure 4:
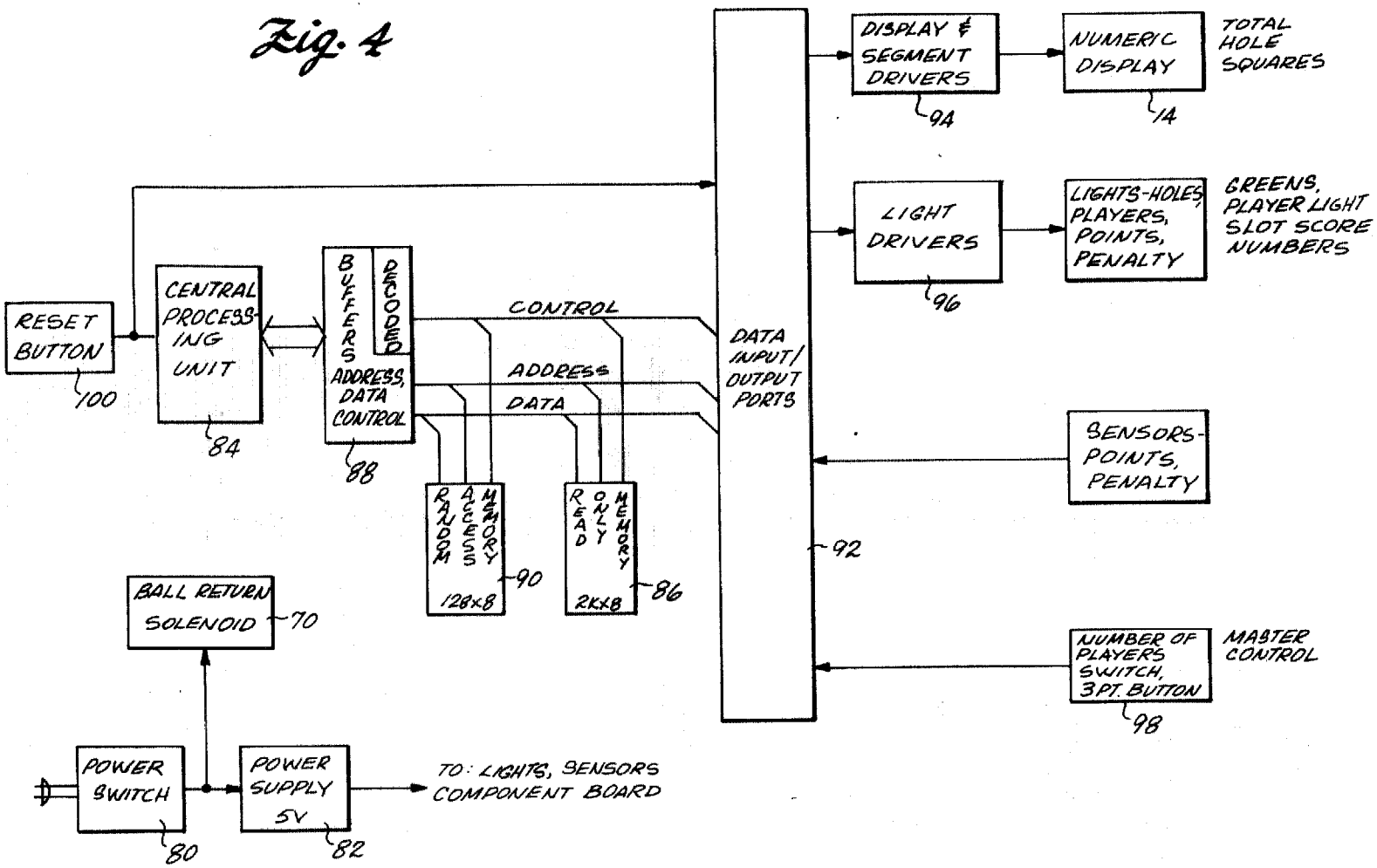
FIG. 4 is a schematic block diagram of the scoring control for the game.

Control of the lights illuminating the numerical displays, the penalty display, and the holes is shown in block form in FIG. 4. A power switch 80 turns on power to a power supply 82 and also to the ball return solenoid 70. The output of the power supply provides power for illuminating the various lights and for the control circuit. The control circuit includes a central processing unit 84 which is preferably standard microprocessor chip which operates in response to a program stored in a Read only memory 86 to control the operation of the game. The central processing unit communicates with the Read only memory over an address and data bus through suitable buffers 88. The central processing unit also communicates with a random access memory 90 over the same address in the data bus. In addition the central processor unit communicates with a plurality of input/output devices through data input-/output ports 92 controlled by the central processing unit. As thus far described, the control circuit is a conventional microprocessing system. One of the input-/outut ports is connected through suitable display and segment drivers 94 to the digital readout units 14 on the display panel 12 for displaying the current score of each of the players of the game. A second output port, by means of a set of light drivers 96, controls the various display lights including the lights indicating a particular hole on the display board 12 and the lights illuminating which player is on the tee, as indicated on the display board 12, the lights illuminating the numerals n the display panel 18 over the ball opening and the light controlling the penalty display segment 22.

One of the input ports is in turn connected to the respective sensors, namely the five position sensors provided by the switch contacts 34 and 36 operated by the flippers 26 and the ball speed sensor provided by the switch contacts 60 and 62. A second input port provides data from a manually operated switch 98 which is set according to the number of players participating in the game, e.g., from one to four players.

A game is initiated by actuating a reset button 100 which may be either manually controlled or controlled by depositing coins in the game. The number of coins may also be used to control the number of player switch 98. Such coin-operated switches are conventional in all types of coin-operated games.

Figure 5:
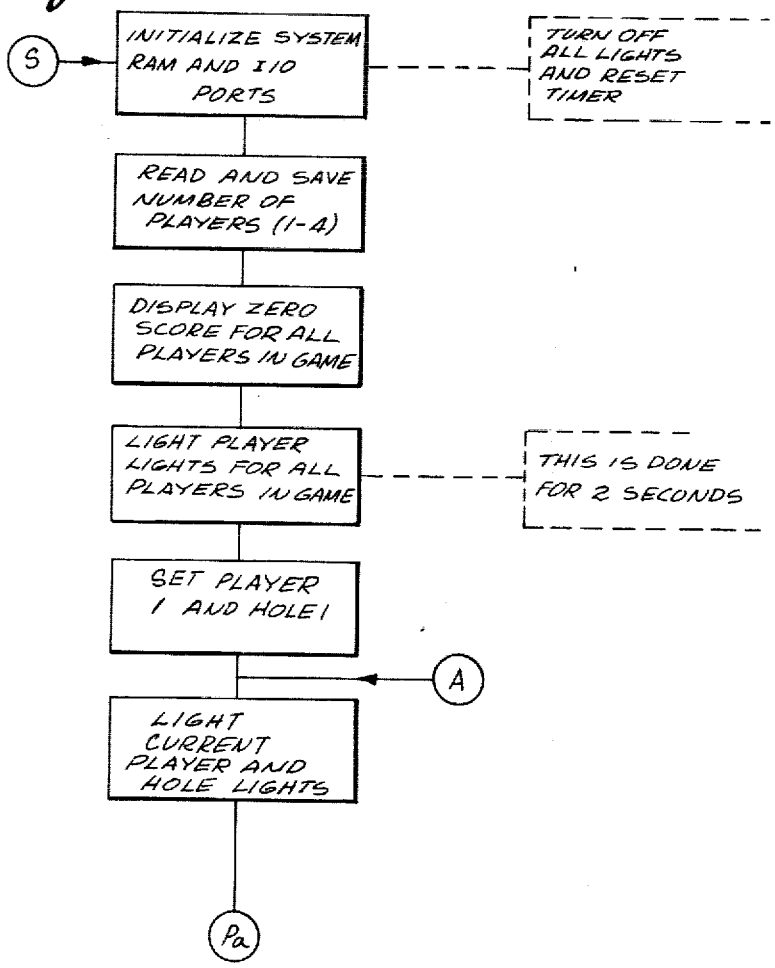
FIGS. 5, 6, and 7 are flow diagrams of the program for controlling the operation of the game.
Figure 6:
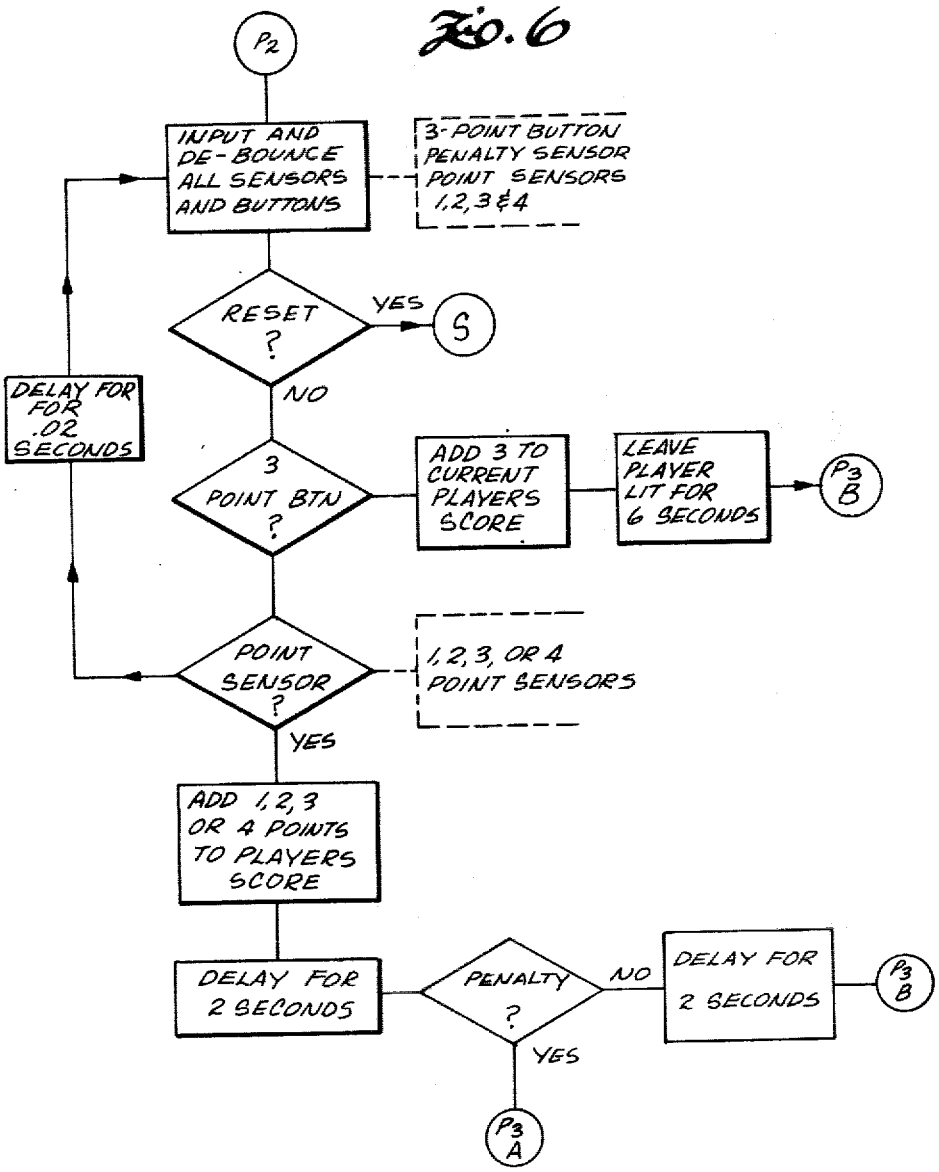
Figure 7:
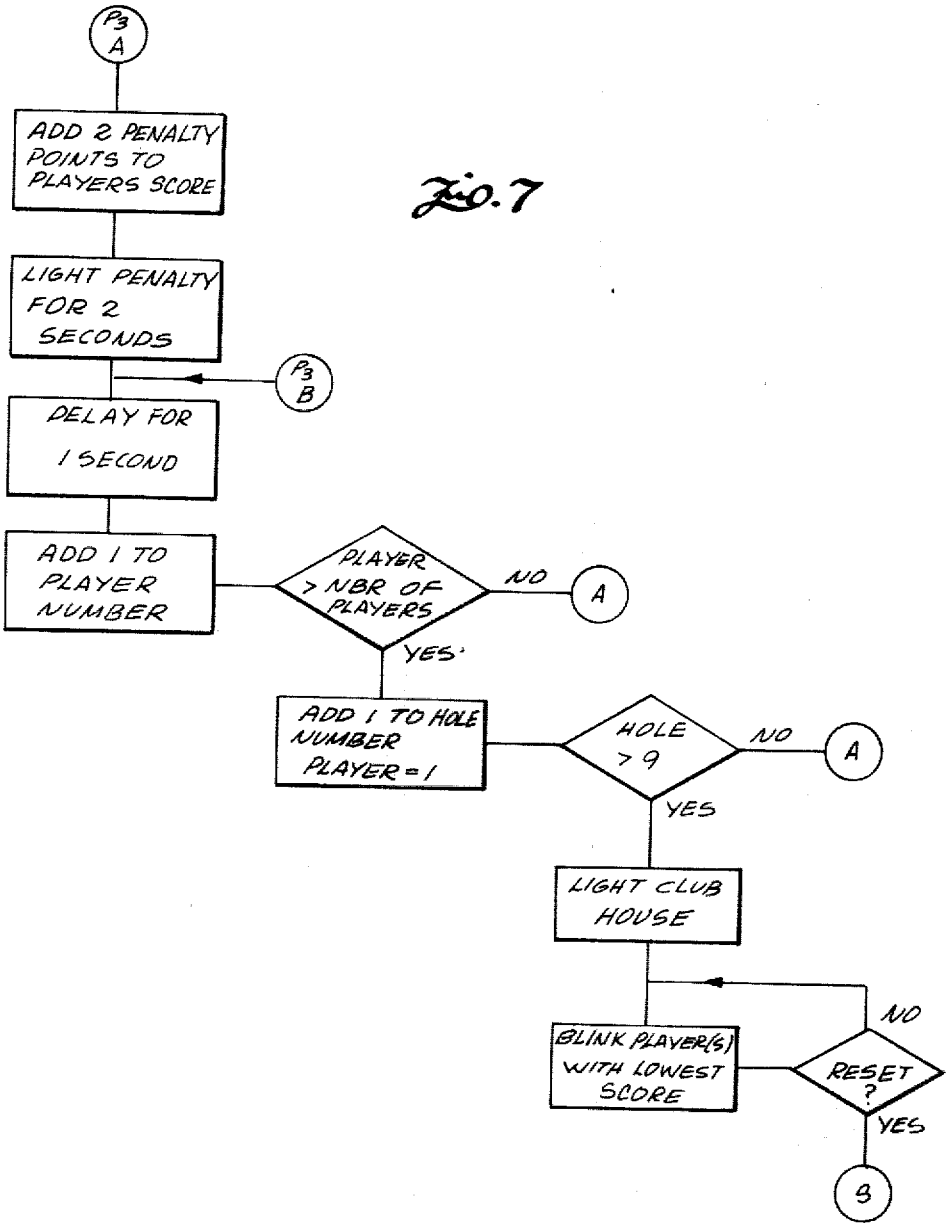

Once the reset button 100 is set, the central processing unit begins to execute the program stored in the Read only memory 86. The flow diagram of the program is shown in FIGS. 5, 6, and 7. Referring to FIG. 5, after the reset button 100 is set, as indicated at S, the control system is initialized by turning off all lights, resetting the timers, initializing the Read only memory and the input/output ports. The program then determines and stores information as to the number of players in the game and displays zero score for all players in the digital readouts 14. The program then activates the 1 on tee light and the light indicating hole number 1 on the panel display 12. The program then enters the player sequence, indicated at $P_2$ in FIG. 6. During the play routine, the program inputs the condition of all the sensors and buttons, including a three-point penalty button which is operated manually when a player fails to putt his ball into the opening 16 to generate a score, such as, for example, where the player putts the ball either to the right or left of the housing 10 or fails to hit the ball hard enough to drive it up the ramp 17. The program then checks to see if the reset button has been reset. If not, it checks to see whether an input was provided from the three-point button and, if not, it determines whether an input was provided by one of the position sensors. The input from each position sensor is coded to store an appropriate point value for the position of the sensor, namely, one point for the middle sensor, two points for the sensors on either side of the middle, and three points for the outermost sensor. The game can also be arranged with seven sensors instead of five, in which case four points are coded for the additional pair of outermost sensors. If none of the position sensors have been activated, the program does another input sequence after a delay of 0.02 seconds.

After inputing the sensors and button, if the reset button has been reset, the program returns to the start at position S in FIG. 5. If the three-point button has been activated, the program addes three points to the value displayed by the digital readout 14 associated with a particular player and identifying the score of that player. It leaves the player score lit for five seconds and then jumps to position $P_{3b}$ of the program shown in the flow diagram of FIG. 7. If the three-point button has not been set, but one of the point sensor switches has been activated, the program adds the appropriate value to the player score displayed in the associated digital readout display 14.

After a delay of two seconds, the program tests to see if the penalty switch provided by the contacts 60 and 62 was activated as the result of the golf ball being putted too hard. If no penalty occurred, the program jumps to position $P_{3b}$ after a delay of two seconds. If a penalty has occurred the program jumps to position $P_{3a}$ of the program, as shown in FIG. 7.

Assuming that a penalty resulting from accessive velocity of the golf ball occurs, as shown in FIG. 7, the program adds a penalty of two points to the players score as displayed on the appropriate output digital display unit 14. At the same time the penalty display light illuminating the display segment 22 is flashed for two seconds, indicating to the player that a penalty has been assessed.

After a one second delay, the player number is increased by 1. If the player number does not then exceed the number of players in the game, the program returns to A in the program, as shown in FIG. 5. If on the other hand the player number is now greater than the number of players in the game, the hole number is increased by one. If the hole number is still less than nine, the program again returns to position A in the flow as shown in FIG. 5. However if the hole number is greater than nine, indicating that all nine holes have been played, the display indicates the game is over by lighting an appropriate indication on the display planel 12, e.g., "Club House", and causes the digital display of the lowest score (or scores in case of a tie) to be blinked on and off to indicate the winning player. This condition continues until the game is reset for the next game. The following is a printout of the program stored in the Read only memory 86 for controlling the operation of the game:

"CELEBRITY PAR 3"

```
                                  7/17/79 "CELEBRITY PAR3"   1
 1 0000                   TITLE                          7/17/79"
 2                        LIST     8
 3                        NLIST    T
 4 0001                ON EQU      1
 5 0002                OFF EQU     2
 6 0002                MDS EQU     OFF
 7 0000                ROM DEFL    0
 8 0800                RAM DEFL    800H
 9                        IF       MDS.EQ.ON
10                     ROM DEFL    6000H
11                     RAM DEFL    6800H
12                        ENDIF
13                     ;
14                     ;
15                     ;       IO PORT EQUATES
16                     ;
17 0000                DSPSEL EQU     0          ;LED DISPLAY SELECT
18                     ;       B0-DSP0, B1-DSP1,....,B7-DSP7
19 0001                SEGSEL EQU     1          ;LED SEGMENT SELECT
20                     ;       B0-SEGA, B1-SEGB,....,B7-SEGG
21 0002                PLYRLT EQU     2          ;BITS 0-3 = PLAYERS 1-4
22 0002                HOLE2  EQU     2          ;BIT 4 = HOLE 9
23 0010                HOLE9  EQU     16
24 0002                CLUBHS EQU     2          ;BIT 5 = CLUBHOUSE
25 0020                CHBIT  EQU     32
26 0004                POINTS EQU     4          ;POINT & PENALTY LIGHTS
27                     ;        BITS  0  1  2  3  4  5  6  7
28                     ;       LITES  4  3  2  1  2  3  4  P
29 0005                HOLE1  EQU     5          ;HOLE LIGHTS
30                     ;       B0-HOLE1, B1-HOLE2,....., B7-HOLE8
31 0006                PADS   EQU     6          ;POINT & PENALTY SENSE
32                     ;        BITS  0  1  2  3  4  5  6  7
33                     ;        PADS  P  4  3  2  1  2  3  4
34 0010                BUTONS EQU     10H ;3 POINT BTN AND NBR OF PLAY
35                     ;       B0-3 PNTS,B1-1 PLAYER,B2-2 PLAYERS,B3-3
36                     ;
37                     ;
38 0800                        ORG    RAM
39                     ;       RAM DEFINITIONS
40                     ;
41 0800                        DS     32
42 0820                STKADR
43 0820 00 00          LEDPTR DW      0          ;LEDTBL POINTER FOR CLK
44 0822                LEDTBL DS      8          ;1 BYTE PER LED
45                     TIMERS                    ;TIMER TABLES
46 082A                TIMER1 DS      3          ; BYTE0 - 100MSEC COUNT
47 082D                TIMER2 DS      3          ; BYTE1 - LIGHT BIT MAS
48 0830                TIMER3 DS      3          ; BYTE3 - PORT ADDR
49 0833                BCDTBL DS      4          ;PLAYERS BCD SCORES
50 0837                BLNKTB DS      4          ;PLAYERS SCORE BLINK TA
51 0838                BTNTAB DS      9          ;BUTTON/PAD DEBOUNCE HI
52 0844 00             MS20   DB      0          ;20 MSEC COUNTER
53 0845 00             MS100  DB      0          ;100 MSEC COUNTER
54 0846 00             PLAYER DB      0          ;CURRENT PLAYER
55 0847 00             HOLE   DB      0          ;CURRENT HOLE
56 0848 00             PLAYRS DB      0          ;NUMBER OF PLAYERS IN G
57                     ;
58                     ;
```

"CELEBRITY PAR 3"

```
                          ;
0000                              ORG     ROM
                          ;
                          ;               PROGRAM AREA
0000 ED 56                START   IM      1
0002 31 20 08                     LD      SP,STKADR ;SET STACK
0005 21 34 03                     LD      HL,INITAB ;SET UP IO PORTS
0008                      LOOP    DEFL    $         ; AND DATA
0008 7E                           LD      A,(HL)
0009 3C                           INC     A         ;PORT OF FF = EOT
000A 28 6D                        JR      Z,INIDON
000C 4E                           LD      C,(HL)    ;GET PORT ADDR
000D 23                           INC     HL
000E ED A3                        OUTI              ;OUT (C),(HL)
0010 18 F6                        JR      LOOP
0038                              ORG     ROM+38H
0038 08                   CLKINT  EX      AF,AF'    ;PROCESS 1 MSEC CLOCK
0039 D9                           EXX
003A ED 5B 20 08                  LD      DE,(LEDPTR) ;GET NEXT LED
003E 21 22 08                     LD      HL,LEDTBL
0041 19                           ADD     HL,DE
0042 7B                           LD      A,E       ;SET UP NEXT
0043 3C                           INC     A
0044 E6 07                        AND     7
0046 32 20 08                     LD      (LEDPTR),A
0049 AF                           XOR     A
004A D3 00                        OUT     (DSPSEL),A ;DE-SELECT THE LED
004C 7E                           LD      A,(HL)
004D 2F                           CPL               ;COMPLIMENT THE SEGMENT
004E D3 01                        OUT     (SEGSEL),A ;SET NEW SEGMENTS
0050 21 90 02                     LD      HL,BITTBL ;GET THE DISPLAY
0053 19                           ADD     HL,DE
0054 7E                           LD      A,(HL)
0055 D3 00                        OUT     (DSPSEL),A
0057 21 44 08                     LD      HL,MS20   ;BUMP THE COUNTERS NOW
005A 34                           INC     (HL)
005B 23                           INC     HL
005C 34                           INC     (HL)
005D 3E 64                        LD      A,100     ;SEE IF TIMERS NEED PRO
005F BE                           CP      (HL)
0060 20 13                        JR      NZ,IOUT
0062 36 00                        LD      (HL),0    ;RESTART IT
0064 DD E5                        PUSH    IX
0066 DD 21 2A 08                  LD      IX,TIMER1
006A CD 99 02                     CALL    TIMER
006D CD 99 02                     CALL    TIMER
0070 CD 99 02                     CALL    TIMER
0073 DD E1                        POP     IX
0075 D9                   IOUT    EXX
0076 08                           EX      AF,AF'
0077 FB                           EI
0078 C9                           RET
                          ;
                          ;
                          ;
0079 01 FF 00             INIDON  LD      BC,255    ;ZERO ALL OF RAM
007C 21 00 08                     LD      HL,RAM
007F 11 01 08                     LD      DE,RAM+1
```

"CELEBRITY BAR 3"

7/17/79 3

```
0082 36 00                LD      (HL),0
0084 ED B0                LDIR
0086 FB                   EI                  ;ALLOW INTERRUPTS NOW
0087 DB 10                IN      A,(BUTONS) ;GET THE NUMBER OF PL
0089 2F                   CPL
008A 1F                   RRA
008B 06 01                LD      B,1         ;1 PLAYER
008D 0E 01                LD      C,1
008F 1F                   RRA
0090 38 0F                JR      C,PLYRIN
0092 04                   INC     B           ;2 PLAYERS
0093 0E 03                LD      C,3
0095 1F                   RRA
0096 38 09                JR      C,PLYRIN
0098 04                   INC     B           ;3 PLAYERS
0099 0E 07                LD      C,7
009B 1F                   RRA
009C 38 03                JR      C,PLYRIN
009E 04                   INC     B           ;4 PLAYERS
009F 0E 0F                LD      C,15
00A1 21 48 08     PLYRIN  LD      HL,PLAYRS ;SAVE THE NBR OF PLAYE
00A4 70                   LD      (HL),B
00A5 11 AE 00             LD      DE,RETURN ;LITE ALL THE PLAYERS
00A8 D5                   PUSH    DE          ;(SIMULATES A CALL)
00A9 C5                   PUSH    BC
00AA 41                   LD      B,C
00AB C3 EF 02             JP      LPLYR2
00AE              RETURN
00AE 78                   LD      A,B         ;NOW SHOW 0 POINTS FOR
00AF              LOOP    DEFL    S
00AF 06 00                LD      B,0
00B1 3D                   DEC     A           ;REAL PLAYER NBR
00B2 CD 21 02             CALL    ADDBCD
00B5 B7                   OR      A
00B6 20 F7                JR      NZ,LOOP
00B8              LOOP    DEFL    S           ;NOW WAIT FOR PLAYER LI
00B8 3A 2A 08             LD      A,(TIMER1)
00BB B7                   OR      A
00BC 20 FA                JR      NZ,LOOP
00BE 47                   LD      B,A         ;BEGIN WITH PLAYER 1
00BF 32 46 08             LD      (PLAYER),A
00C2 CD 19 02             CALL    TREPT3
00C5 06 00                LD      B,0         ; AND HOLE 1
00C7 CD 68 02             CALL    LITHOLE
                  ;
                  ;
                  ;       IDLE LOOP OF PROGRAM
                  ;
00CA 31 20 08     IDLE    LD      SP,STKADR ;PLAYING IT SAFE
00CD 21 44 08             LD      HL,MS20   ;WAIT TILL 20 MSEC PASS
00D0              LOOP    DEFL    S
00D0 7E                   LD      A,(HL)
00D1 FE 14                CP      20
00D3 38 FB                JR      C,LOOP
00D5 36 00                LD      (HL),0    ;RESET THE COUNTER
00D7 21 38 08             LD      HL,STATAB ;INPUT THE BUTTONS AND
00DA DB 10                IN      A,(BUTONS) ;GET THESE POINT BUTT
00DC 2F                   CPL
```

"CELEBRITY PAR 3"

```
00DD 1F                          RRA
00DE CB 1E                       RR      (HL)      ;INTO ITS HISTORY BYTE
00E0 23                          INC     HL
00E1 06 08                       LD      B,8       ;NOW DO THE 8 PADS
00E3 DB 06                       IN      A,(PADS)
00E5 2F                          CPL
00E6                     LOOP    DEFL    $
00E6 1F                          RRA
00E7 CB 1E                       RR      (HL)
00E9 23                          INC     HL
00EA 10 FA                       DJNZ    LOOP
                         ;
                         ;
                         ;
                         ;       NOW SEE IF ANY INPUTS REQUIRE PROCESSING
                         ;
00EC 3A 47 08                    LD      A,(HOLE) ;IF HOLE = 10
00EF FE 09                       CP      9        ; F I N I
00F1 28 26                       JR      Z,IDLE1
00F3 21 3B 08            DOBTNS  LD      HL,BTNTAB ;DEBOUNCE HISTORY BYTE
00F6 DD 21 20 03                 LD      IX,ADRTAB ; ROUTINE ADDR TABLE
00FA                     LOOP    DEFL    $
00FA DD 7E 00                    LD      A,(IX+0) ;ADDR OF 0
00FD DD B6 01                    OR      (IX+1)   ; = E O T
0100 28 C8                       JR      Z,IDLE
0102 7E                          LD      A,(HL)
0103 FE 80                       CP      80H      ; HISTORY OF 10000000B
0105 20 0B                       JR      NZ,NXTBTN ;  = PROCESS BUTTON/PA
0107 DD 66 01                    LD      H,(IX+1) ;GET PROGRAM ADDR
010A DD 6E 00                    LD      L,(IX+0)
010D 11 CA 00                    LD      DE,IDLE  ;RETURN IS TO IDLE
0110 D5                          PUSH    DE
0111 E9                          JP      (HL)     ;STIMULATE A CALL
0112 23                  NXTBTN  INC     HL
0113 DD 23                       INC     IX
0115 DD 23                       INC     IX
0117 18 E1                       JR      LOOP
0119 3A 2D 08            IDLE1   LD      A,(TIMER2) ;HAS LAST POINT TURNE
011C B7                          OR      A
011D 20 FA                       JR      NZ,IDLE1 ;NOT YET - LOOP SOMEORE
011F 3A 48 08                    LD      A,(PLAYRS) ;FIND THE PLAYER WITH
0122 47                          LD      B,A      ; THE LOWEST SCORE
0123 21 33 08                    LD      HL,BCDTBL ; (KEEP IN MIND THERE
0126 3E 99                       LD      A,99H
0128 11 00 00                    LD      DE,0
012B                     LOOP    DEFL    $
012B BE                          CP      (HL)     ; A<(HL) ??
012C 38 02                       JR      C,SKIP1  ; A=LOWER
012E 7E                          LD      A,(HL)   ; (HL)=LOWER
012F 5A                          LD      E,D      ; SAVE BOTH SCORE AND P
0130 14                  SKIP1   INC     D
0131 23                          INC     HL       ;GO NEXT ONE
0132 10 F7                       DJNZ    LOOP
0134 01 04 04                    LD      BC,404H  ;A=LOWEST SCORE, E=PLAY
0137 DD 21 37 08                 LD      IX,SLNKTB ; NOW SEE IF MORE THAN
013B 21 33 08                    LD      HL,BCDTBL ; HAD THE LOWEST SCORE
013E                     LOOP    DEFL    $
013E DD 36 00 00                 LD      (IX+0),0
```

"CELEBRITY PAR3"

7/17/79 5

```
233 0142 BE                    CP      (HL)       ;TO BLINK OR NOT TO BLI
234 0143 20 04                 JR      NZ,SKIP2 ;NOT TO BLINK
235 0145 DD 36 00 01           LD      (IX+0),1 ;     TO BLINK
236 0149 DD 23          SKIP2  INC     IX
237 014B 23                    INC     HL         ;DO NEXT ONE
238 014C 10 F0                 DJNZ    LOOP
239 014E 21 22 08              LD      HL,LEDTBL ;BLNKTB = 1 FOR EACH P
240 0151 16 00                 LD      D,0        ;GET THE SEGMENTS NOW
241 0153 19                    ADD     HL,DE
242 0154 19                    ADD     HL,DE
243 0155 56                    LD      D,(HL)
244 0156 23                    INC     HL
245 0157 5E                    LD      E,(HL)
246 0158 AF                    XOR     A
247 0159 41             BLANK  LD      B,C        ;BLANK THE SEGMENTS FOR
248 015A DD 21 22 08           LD      IX,LEDTBL ; PLAYER WITH THE LOWE
249 015E 21 37 08              LD      HL,BLNKTB
250 0161                LOOP   DEFL    $
251 0161 BE                    CP      (HL)
252 0162 28 06                 JR      Z,SKIP3
253 0164 DD 77 00              LD      (IX+0),A
254 0167 DD 77 01              LD      (IX+1),A
255 016A DD 23          SKIP3  INC     IX
256 016C DD 23                 INC     IX
257 016E 23                    INC     HL
258 016F 10 F0                 DJNZ    LOOP
259 0171 CD 91 01              CALL    WAIT       ;WAIT A BIT NOW
260 0174 41                    LD      B,C        ;NOW RESTORE THE BLANKE
261 0175 DD 21 22 08           LD      IX,LEDTBL
262 0179 21 37 08              LD      HL,BLNKTB
263 017C                LOOP   DEFL    $
264 017C BE                    CP      (HL)
265 017D 28 06                 JR      Z,SKIP4
266 017F DD 72 00              LD      (IX+0),D
267 0182 DD 73 01              LD      (IX+1),E
268 0185 DD 23          SKIP4  INC     IX
269 0187 DD 23                 INC     IX
270 0189 23                    INC     HL
271 018A 10 F0                 DJNZ    LOOP
272 018C CD 91 01              CALL    WAIT       ;WAIT SOME MORE
273 018F 18 C8                 JR      BLANK      ;GO BLINK UNTIL RESET
274 0191 06 C8          WAIT   LD      B,200      ;DELAY FOR 200 MSEC
275 0193 76             WAIT1  HALT
276 0194 10 FD                 DJNZ    WAIT1
277 0196 C9             PRET   RET
278                     ;
279                     ;
280                     ;
281                     ;      PROCESSING ROUTINES
282                     ;
283 0197 06 02          PENALTY LD     B,2        ;PENALTY = 2 POINTS
284 0199 CD 12 03              CALL    LITPEN     ;LIGHT THE PENALITY LIG
285 019C 3A 46 08              LD      A,(PLAYER) ;ADD IN THE PENALTY
286 019F C3 21 02              JP      ADDBCD
287                     ;
288                     ;
289 01A2 06 01          PAD4R  LD      B,1        ;POINT 4 RIGHT
290 01A4 CD 08 03       PAD4   CALL    LITPNT     ;LIGHT THE POINT
```

"CELEBRITY PARS"

```
01A7 06 04                    LD      B,4        ;ADD IN THE POINTS
01A9 18 29                    JR      TREPT2
01AB 06 40            PAD4L   LD      B,64       ;POINT 4 LEFT
01AD 18 F5                    JR      PAD4
                      ;
                      ;
01AF 06 02            PAD3R   LD      B,2        ;POINT 3 RIGHT
01B1 CD 08 03         PAD3    CALL    LITPNT
01B4 06 03                    LD      B,3
01B6 18 1C                    JR      TREPT2
01B8 06 20            PAD3L   LD      B,32
01BA 18 F5                    JR      PAD3
                      ;
                      ;
01BC 06 04            PAD2R   LD      B,4        ;POINT 2 RIGHT
01BE CD 08 03         PAD2    CALL    LITPNT
01C1 06 02                    LD      B,2
01C3 18 0F                    JR      TREPT2
01C5 06 10            PAD2L   LD      B,16
01C7 18 F5                    JR      PAD2
                      ;
                      ;
01C9 06 08            PAD1    LD      B,8        ;POINT 1
01CB CD 08 03                 CALL    LITPNT
01CE 06 01                    LD      B,1
01D0 18 02                    JR      TREPT2
                      ;
                      ;
01D2 06 03            TREPNT  LD      B,3        ;THREE POINT BUTTON
01D4 3A 46 08         TREPT2  LD      A,(PLAYER) ;ADD 3 TO CURRENT PLA
01D7 CD 21 02                 CALL    ADDBCD
01DA 21 2A 08                 LD      HL,TIMER1  ;LEAVE PLAYER LIT FOR
01DD 36 32                    LD      (HL),50
01DF                  LOOP    DEFL    $
01DF DB 06                    IN      A,(PADS)   ;CHECK FOR PENALTY
01E1 2F                       CPL
01E2 E6 01                    AND     1
01E4 20 07                    JR      NZ,DOPEN   ;FOR 500MSEC
01E6 7E                       LD      A,(HL)
01E7 FE 2D                    CP      45
01E9 30 F4                    JR      NC,LOOP
01EB 18 08                    JR      SKPEN
01ED 7E               DOPEN   LD      A,(HL)     ;DONT SHOW PENALTY
01EE FE 1E                    CP      30         ; FOR A BIT
01F0 30 F6                    JR      NC,DOPEN
01F2 CD 97 01                 CALL    PENALTY    ;DO THE PENALTY NOW
01F5 3A 2A 08         SKPEN   LD      A,(TIMER1) ;NOW WAIT FOR TIMER1
01F8 B7                       OR      A          ; TO EXPIRE
01F9 20 FA                    JR      NZ,SKPEN
01FB 21 46 08                 LD      HL,PLAYER  ;DO NEXT PLAYER STUFF
01FE 34                       INC     (HL)
01FF 3A 48 08                 LD      A,(PLAYRS)
0202 BE                       CP      (HL)       ;ALL DONE THIS HOLE ??
0203 46                       LD      B,(HL)
0204 20 13                    JR      NZ,TREPT3  ;NOT YET
0206 36 00                    LD      (HL),0     ;RESET CURRENT PLAYER N
0208 21 47 08                 LD      HL,HOLE    ;GO TO NEXT HOLE
020B 34                       INC     (HL)
```

"CELEBRITY PAR 3"

```
349 020C 46                 LD      B,(HL)
350 020D CD 68 02           CALL    LITHOLE
351 0210 3E 09              LD      A,9         ;SEE IF IN CLUBHOUSE
352 0212 BE                 CP      (HL)
353 0213 06 00              LD      B,0         ;LITE PLAYER 1
354 0215 20 02              JR      NZ,TREPT3
355 0217 06 08              LD      B,8         ;TURN OFF THE PLAYERS
356 0219 CD E7 02           CALL    LITPLYR     ;LIGHT THE PLAYER LITE
357 021C DD 36 00 00        LD      (IX+0),0    ;FOR EVER
358 0220 C9                 RET
359                         ;
360                         ;
361                         ;       UTILITIES AND OTHER STUFF
362                         ;
363 0221 F5                 ADDBCD  PUSH    AF          ;A = PLAYER NBR (0 TO N
364 0222 21 33 08           LD      HL,BCDTBL   ;B = BINARY NBR TO ADD
365 0225 CD 63 02           CALL    ADA2HL
366 0228 7E                 LD      A,(HL)      ;OLD BCD
367 0229 80                 ADD     A,B         ;           + B
368 022A 27                 DAA                 ;               = NEW BCD
369 022B 47                 LD      B,A         ;SAVE BCD IN B
370 022C 70                 LD      (HL),B      ;   AND HL
371 022D F1                 POP     AF          ;RESTORE PLAYER
372 022E F5                 PUSH    AF
373 022F 21 22 08           LD      HL,LEDTBL   ; TO SET UP SEGMENT ST
374 0232 87                 ADD     A,A         ;TWO BYTES PER PLAYER
375 0233 CD 63 02           CALL    ADA2HL
376 0236 EB                 EX      DE,HL
377 0237 78                 LD      A,B
378 0238 CD 4C 02           CALL    GETSEG      ;CVT BCD TO 7 SEGMENTS
379 023B 13                 INC     DE
380 023C 78                 LD      A,B
381 023D 1F                 RRA
382 023E 1F                 RRA
383 023F 1F                 RRA
384 0240 1F                 RRA
385 0241 E6 0F              AND     15          ;SEE IF MSB = 0
386 0243 20 02              JR      NZ,ADBCD2
387 0245 3E 0A              LD      A,10        ;IF MSB = 0  THEN MSB =
388 0247 CD 4C 02           ADBCD2  CALL    GETSEG
389 024A F1                 POP     AF
390 024B C9                 RET
391 024C E6 0F              GETSEG  AND     15
392 024F 21 57 02           LD      HL,SEGTBL
393 0251 CD 63 02           CALL    ADA2HL
394 0254 7E                 LD      A,(HL)
395 0255 12                 LD      (DE),A
396 0256 C9                 RET
397 0257 3F                 SEGTBL  DB      3FH,6,5BH,4FH
    0258 06
    0259 5B
    025A 4F
398 025B 66                 DB      66H,6DH,7DH,7
    025C 6D
    025D 7D
    025E 07
399 025F 7F                 DB      7FH,67H,0
    0260 67
```

"CELEBRITY PAR 3"

7/17/79 8

```
    0261 00
400                         ;
401                         ;
402 0262 78                 ADB2HL LD      A,B
403 0263 85                 ADA2HL ADD     A,L
404 0264 6F                        LD      L,A
405 0265 D0                        RET     NC
406 0266 24                        INC     H
407 0267 C9                        RET
408                         ;
409                         ;
410 0268 AF                 LITHOLE XOR    A          ;FIRST TURN OFF HOLE LI
411 0269 D3 05                     OUT     (HOLE1),A
412 026B DB 02                     IN      A,(HOLE2)
413 026D E6 EF                     AND     .NOT.HOLE9
414 026F D3 02                     OUT     (HOLE2),A
415 0271 78                        LD      A,B        ;NOW SEE WHICH HOLE TO
416 0272 FE 08                     CP      8
417 0274 38 09                     JR      C,DO1TO8
418 0276 20 11                     JR      NZ,DOCLUB
419 0278 DB 02                     IN      A,(HOLE2) ;LIGHT HOLE 9
420 027A F6 10                     OR      HOLE9
421 027C D3 02                     OUT     (HOLE2),A
422 027E C9                        RET
423 027F 21 90 02           DO1TO8 LD      HL,BITTBL
424 0282 CD 62 02                  CALL    ADB2HL
425 0285 7E                        LD      A,(HL)
426 0286 D3 05                     OUT     (HOLE1),A
427 0288 C9                        RET
428 0289 DB 02              DOCLUB IN      A,(CLUBHS) ;LIGHT THE CLUB HOUSE
429 028B F6 20                     OR      CHBIT
430 028D D3 02                     OUT     (CLUBHS),A
431 028F C9                        RET
432 0290 01                 BITTBL DB      1,2,4,8
    0291 02
    0292 04
    0293 08
433 0294 10                        DB      16,32,64,128
    0295 20
    0296 40
    0297 80
434 0298 00                        DB      0
435                         ;
436                         ;
437 0299 DD 7E 00           TIMER  LD      A,(IX+0) ;PROCESS TIMER TABLE
438 029C B7                        OR      A
439 029D 28 11                     JR      Z,TIMOUT ;COUNTER = 0 - EXIT
440 029F DD 35 00                  DEC     (IX+0)   ;DECREMENT THE COUNTER
441 02A2 20 0C                     JR      NZ,TIMOUT ;NOT ZERO YET - EXIT
442 02A4 DD 46 01                  LD      B,(IX+1) ;GET BIT MASK
443 02A7 DD 4E 02                  LD      C,(IX+2) ;GET PORT ADDRESS
444 02AA ED 78                     IN      A,(C)    ;TURN OFF THE LIGHT NOW
445 02AC B0                        OR      B
446 02AD A8                        XOR     B
447 02AE ED 79                     OUT     (C),A
448 02B0 DD 23              TIMOUT INC     IX
449 02B2 DD 23                     INC     IX
450 02B4 DD 23                     INC     IX
```

"CELEBRITY PAR 3"

```
02B6 C9                    RET
                     ;
                     ;
02B7                       DS      30H        ;SKIP BAD SPOT IN EPROM
02E7 C5              LITPLYR PUSH  BC         ;SAVE BC FOR FUN
02E8 21 90 02                LD    HL,BITTBL  ;GET THE PLAYER BIT
02EB CD 62 02                CALL  ADB2HL
02EE 46                      LD    B,(HL)     ;BIT MASK TO B
02EF 0E 02           LPLYR2  LD    C,PLYRLT   ;PORT ADDR TO C
02F1 DD 21 2A 08             LD    IX,TIMER1  ;TIMER TABLE TO IX
02F5 ED 78                   IN    A,(C)      ;TURN OFF OTHER PLAYERS
02F7 E6 F0                   AND   0F0H
02F9 B0                      OR    B          ;SET NEW PLAYER
02FA ED 79           SETTMR  OUT   (C),A      ;LIGHT LIGHT
02FC DD 36 00 14             LD    (IX+0),20  ;SET 2 SEC COUNT
0300 DD 70 01                LD    (IX+1),B   ;SET BIT MASK
0303 DD 71 02                LD    (IX+2),C   ;SET PORT ADDR
0306 C1                      POP   BC         ;RESTORE B
0307 C9                      RET
                     ;
                     ;
0308 C5              LITPNT  PUSH  BC
0309 0E 04                   LD    C,POINTS   ;POINT LIGHT PORT
030B DD 21 2D 08             LD    IX,TIMER2  ;TIMER TABLE
030F 78                      LD    A,B        ;BIT MASK
0310 18 E8                   JR    SETTMR
                     ;
                     ;
0312 C5              LITPEN  PUSH  BC
0313 DD 21 30 08             LD    IX,TIMER3  ;PENALTY TIMER TABLE
0317 06 80                   LD    B,80H      ;PENALTY BIT MASK
0319 0E 04                   LD    C,POINTS   ;PORT ADDR
031B ED 78                   IN    A,(C)      ;SAVE OTHER BITS
031D B0                      OR    B          ;SET PENALTY LIGHT
031E 18 DA                   JR    SETTMR
                     ;
                     ;
0320 02 01           ADRTAB  DW    TREPNT     ;THREE POINT PGM
0322 96 01                   DW    PRET       ;PENALTY PGM
0324 A2 01                   DW    PAD4R
0326 AF 01                   DW    PAD3R
0328 BC 01                   DW    PAD2R
032A C9 01                   DW    PAD1
032C C5 01                   DW    PAD2L
032E B8 01                   DW    PAD3L
0330 AB 01                   DW    PAD4L
0332 00 00                   DW    0
                     ;
                     ;
00FF                 FF      EQU   0FFH
0334 03              INITAB  DB    3,80H      ;SET UP PORTS 0 - 2
0335 80
0336 07                      DB    7,89H      ;SET UP PORTS 4 - 6
0337 89
0338 01                      DB    1,15,0,FF  ;BLANK LEDS
0339 0F
033A 00
033B FF
```

"CELEBRITY PAL 3"

7/17/79 10

```
504 033C 02          DB      2,0,3,0   ;TURN OFF LIGHTS
    033D 00
    033E 03
    033F 00
505 0340 04          DB      4,0
    0341 00
506 0342 FF          DB      FF        ;E O T
507 0343             END     START

ERRORS = 0000
```

What is claimed is:

1. A game device comprising: a housing having a base adapted to rest on a horizontal supporting surface and front panel extending upwardly from the base, the front panel having an elongated opening extending horizontally along the base for receiving the ball rolled toward the housing on said supporting surface, a plurality of laterally spaced position sensors positioned in the housing adjacent the opening in the housing for sensing movement of a ball through the opening, the ball activating particular ones of the sensors depending on the lateral position of the ball relative to the housing as it enters the opening, means in the housing for sensing when the speed of a ball entering the housing through the opening exceeds a predetermined velocity, said speed sensing means including means for defining said predetermined velocity means responsive to said position sensors for indicating a numerical value dependent on which of said position sensors are activated by the ball, and means responsive to said means sensing the speed of the ball for modifying the indicated numerical value when the speed of a ball exceeds said predetermined velocity.

2. Apparatus of claim 1 further including adder-accumulator means for indicating the sum of the numerical values produced by a sequence of balls entering the opening.

3. Apparatus of claim 2 further including additional adder-accumulator means for indicating the sum of the numerical values produced by additional sequence of balls entering the opening.

4. Apparatus of claim 3 further including means indicating numerically the number of balls in a sequence that have entered the opening.

5. Apparatus of claim 3 including switching means for setting the number of sequences to be indicated.

6. A game device comprising a housing having a base adapted to rest on a horizontal supporting surface, the housing having a horizontally elongated opening extending up from the base into which a ball can be rolled from the supporting surface, a plurality of laterally spaced sensors in the housing positioned lengthwise of the elongated opening for sensing the lateral position of a ball entering the opening, means responsive to the respective sensors for generating different numerical values for different lateral positions of a ball entering the opening, a plurality of numerical indicator means responsive to said sensors for separately indicating the numerical values generated by said sensors in response to each of a predetermined number of balls in a group entering the opening in sequence, accumulator means associated with each of said pluality of indicator means for adding and accumulating the indicated values for each of the balls in subsequent groups of balls entering the opening in sequence, whereby an accumulated numerical value for each ball in successive groups of balls is separately indicated, and means responsive to the speed of a ball entering the opening for modifying the numerical value generated by any one of said horizontally spaced sensors by a fixed amount when the speed of the ball exceeds a predetermined velocity, said speed responsive means includes means for defining said predetermined velocity whereby the numerical value is indicative of both the relative position and speed of the ball.

7. Apparatus of claim 6 further including means indicating the number of the group of balls being received in the opening, and means advancing the indicated number with each successive group of balls.

8. Apparatus of claim 6 further including a display panel on the housing illustrating a plurality of numbered golf holes, lighting means selectively illuminating any one of said number holes, and means advancing the lighting means for one number hole to the next after each group of balls is received through the opening.

9. Apparatus of claim 6 further including a ramp sloping upwardly from the base within the housing behind the opening, the means responsive to the speed of the ball including a hinged panel adjacent the top of the ramp against which a ball entering the opening impinges, spring means urging the panel toward the opening, and switch means actuated by movement of the panel away from the opening by a ball entering the opening and striking the panel with sufficient speed to overcome the spring means and move the panel.

10. Apparatus of claim 9 further including ball return means positioned in the housing adjacent one end of the opening, and ramp means in the housing directing a ball to the ball return means after the ball strikes the panel.

* * * * *